United States Patent [19]

Nagai

[11] Patent Number: 4,760,961

[45] Date of Patent: Aug. 2, 1988

[54] MODULAR SPRAYHEAD ASSEMBLY

[75] Inventor: Masashi Nagai, Gahanna, Ohio

[73] Assignee: The Snair Company, Hilliard, Ohio

[21] Appl. No.: 14,832

[22] Filed: Feb. 13, 1987

[51] Int. Cl.[4] ..... B05B 1/20

[52] U.S. Cl. ..... 239/267; 164/267; 239/397; 239/412; 239/536; 239/554; 239/560; 239/562; 239/566; 239/600; 239/DIG. 1

[58] Field of Search ..... 239/266, 267, 268, 390, 239/391, 397, 412, 417.5, 536, 554, 555, 556, 560, 562, 565, 566, 600, DIG. 1; 164/267, 268

[56] References Cited

U.S. PATENT DOCUMENTS

| | | | |
|---|---|---|---|
| 392,211 | 11/1888 | Lutz | 239/266 |
| 1,126,614 | 1/1915 | Bustin | 239/554 |
| 2,392,540 | 1/1946 | Lyman | 239/266 |
| 3,456,882 | 7/1969 | Walker | 239/412 |
| 3,589,612 | 6/1971 | Shaffer | 239/600 |
| 4,247,047 | 1/1981 | Schaming | 239/562 |
| 4,293,024 | 10/1981 | Kikuchi et al. | 164/303 |
| 4,306,587 | 12/1981 | Tchebinyayeff | 239/417.5 |

*Primary Examiner*—Andres Kashnikow
*Assistant Examiner*—Michael J. Forman
*Attorney, Agent, or Firm*—Robert B. Watkins

[57] ABSTRACT

A modular spraying assembly particularly adapted for use with automatic molding or dye casting machines which is characterized by a plurality of identical sprayhead modules which can be mounted in linear relationship to one another to form variable vertical and horizontal columns accomodating the particular design of a mold or dye which may be sprayed. A support hanger and manifold blocks are provided to communicate a source of air pressure and liquid mold release compound or lubricant to each linear column of spray head modules. Each sprayhead module is mounted in communication with the sprayhead modules forming a given linear column via a plurality of parallel bores which form air and liquid supply passages common to all sprayheads in the linear column and through which tie rods extend to provide a convenient connecting means for any given number of sprayhead modules in the linear array.

8 Claims, 3 Drawing Sheets

20
22
33
34
37
44
40
112
110
88
92

20
22
24
26
28
30
32
33
34
35
36
37
38
39
40
41
42
44
46
88
110
112
3
4
5

MODULAR SPRAYHEAD ASSEMBLY

TECHNICAL FIELD

The present invention relates generally to a sprayhead assembly for use in delivering a liquid coating and particularly to a spraying assembly for spraying release compounds or lubricants onto the surface of the molds or dye cavities of automated article forming machines.

BACKGROUND

It is a common practice in the operation of automatic article forming machines, such as molding and dye casting machines, to spray the mold or dye surfaces with a release compound or lubricant during each article forming cycle. In conventional practice, each time the machine components separate and the article formed is removed, the mold or dye cavities are sprayed with a compound which prevents the formed article from adhering to the machine surfaces. Typically, the spraying assembly is automatically moved between the separated members of article forming machine after the formed article is removed. The release compound or other liquid is then sprayed on the appropriate surfaces and the spraying assembly is automatically withdrawn and a new forming cycle is initiated. However, the fact that many different mold or dye patterns are employed having a variety of different dimensions creates a particularly difficult problem in providing a spray assembly which provides the proper spray nozzle orientation to deliver the sprayed liquid in the desired pattern matching the mold patterns. Prior spraying devices have not satisfactorily provided a sprayhead assembly which can be economically manufactured and fabricated and still provide the flexibility of spray patterns necessary to meet the variety of requirements of modern mold and dye casting operations.

Examples of prior art spraying assemblies useful for such article forming apparatus are shown in U.S. Pat. Nos. 3,633,651; 4,230,270; 4,293,024 and 3,851,820. However, each of these prior art devices provide a spraying assembly which is not as flexible as desired or requires relatively expensive manufacturing techniques to provide an assembly which is adapted to meet a given mold or die casting application.

SUMMARY OF THE INVENTION

The present invention provides a modular sprayhead assembly for use with automated article forming machines to deliver release compounds or lubricants onto the mold surfaces of such machines.

In accordance with the present invention, a plurality of identical sprayhead modules are provided which may be assembled in a large variety of linear or columnar arrays in both vertical and horizontal directions.

Further, each sprayhead module of a given linear array can be disposed in selected 180 degree rotated postions relative to other modules in the same linear column. The housing or body of each spray module is identical and includes the necessary valving components and passages for the nozzle means in addition to parallel supply passages for air pressure and liquid. When modules are aligned with one another in a linear arrangement these parallel supply passages are aligned to form common air and liquid supply passages for the entire linear array of modules.

The module housings are mounted in the linear array in sealed communication with one another via a pair of tie rods extending through the aligned air supply passages in each housing.

A support hanger and a manifold block are provided upon which the linear arrays of sprayheads are mounted and can be adapted via auxilliary manifold blocks to conventionally provide a multitude of vertical and horizontal patterns in a simple and easy fashion to meet a variety of field applications. The particular spray pattern can be simply and readily changed by merely the re-arrangement of the sprayhead modules and manifold blocks to provide a new pattern when the mold pattern is changed on the article forming machine.

When modification of an existing sprayhead assembly pattern is desired, merely loosening the tie rods connecting each linear array of sprayhead permits one to quickly re-arrange the number and orientation of the modules and manifolds as required to properly direct the nozzles in the most efficient pattern required to deliver the liquid spray onto the mold cavities.

Blank housing having the identical air and liquid supply passages as the sprayhead housing are provided to function as spacers along a given linear array to further selectively position the nozzle in a desired orientation.

As a further aspect of the present invention, the standarization of identical sprayhead modules and manifold blocks lowers manufacturing costs. Additionally, replacement parts are relatively inexpensive and fit all applications as each sprayhead module, the secondary manifolds and blank blocks are standarized and interchangeable with one another. Therefore, in accordance with the present invention, a modular building block assembly of sprayheads can be inexpensively provided for assembly by the customer to provide a multitude of spray patterns as required for a given application and can be readily modified on the job site to meet changing pattern requirements in a relatively quick and easy manner.

IN THE DRAWINGS

DETAILED DESCRIPTION OF THE DRAWINGS

Figure 2:
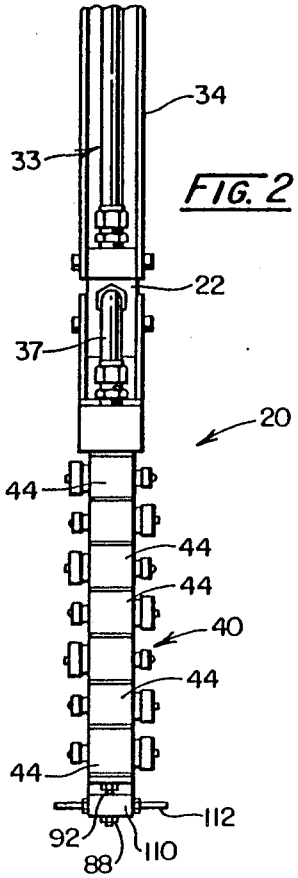
FIG. 2 is a side elevational view of the assembly shown in FIG. 1.
Figure 1:
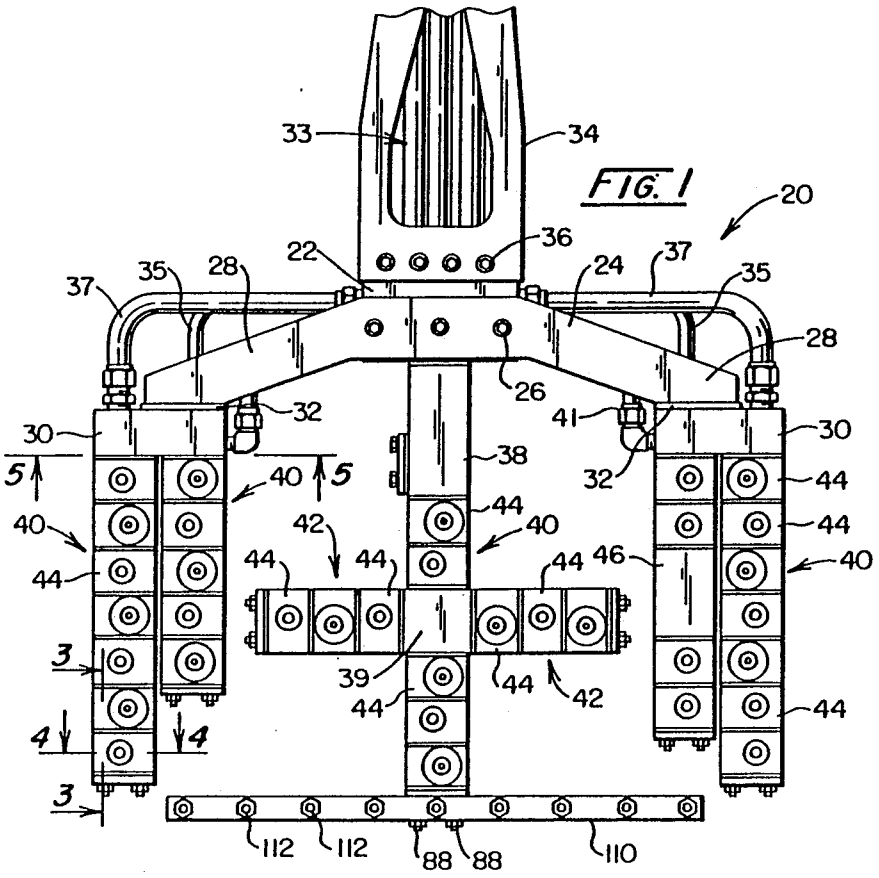
FIG. 1 is a front elevational view of a modular sprayhead assembly for use in connection with article forming machines constructed in accordance with the present invention.

A modular sprayhead assembly, indicated generally at 20, constructed in accordance with the present invention is shown in FIGS. 1 and 2 and includes a manifold block 22 mounted to a support hanger 24 via threaded fasteners, such as 26. In the embodiment shown, hanger 24 is provided with laterally extending arms 28 which provide a support means for manifold blocks 30 fixedly connected to the outer ends of each arm 28 via mounting plates 32 in any conventional manner. In turn, the respective plates 32 are fixed to each manifold 30.

The manifold hanger support assembly described is mounted to the movable arm 34 of a conventional robot apparatus, not shown, via threaded fasteners, such as 36, which are bolted to a primary manifold 22. Arm 34 directs the movement of the assembly into and out of an operating position between the movable members of a molding or die casting machine in a conventional manner coordinated with the machine cycle.

Supply conduits indicated generally at 33 are conventionally mounted to arm 34 and communicate to supply sources, not shown, of pressurized air and a liquid and to primary manifold 22. The air and liquid are then distributed via conventional drilled passages in manifold 22 to distributing conduits 35, 37 and 41. Two of these conduits communicate air and the other liquid to manifolds 30.

Another manifold member 38 is provided which is operatively connected to manifold 22 to illustrate the versatility of creating diverse spray patterns in accordance with the present invention. Each of the manifolds shown includes appropriate conventionally drilled passages to operatively communicate air pressure and liquid to the sprayhead assembly in an organized manner as will be evident from the detailed description following herein. A junction manifold, such as 39, is provided to permit horizontal extention of a vertical, linear array of modules.

Figure 3:
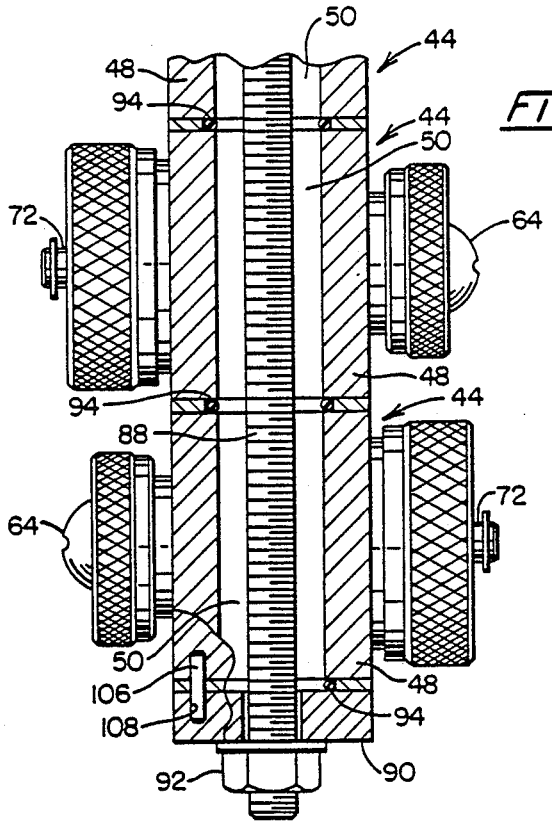
FIG. 3 is a side elevational view in section of a portion of the apparatus shown in FIG. 1, the section being taken along line 3—3 in FIG. 1, illustrating adjacent sprayhead modules and the interconnecting means.
Figure 4:
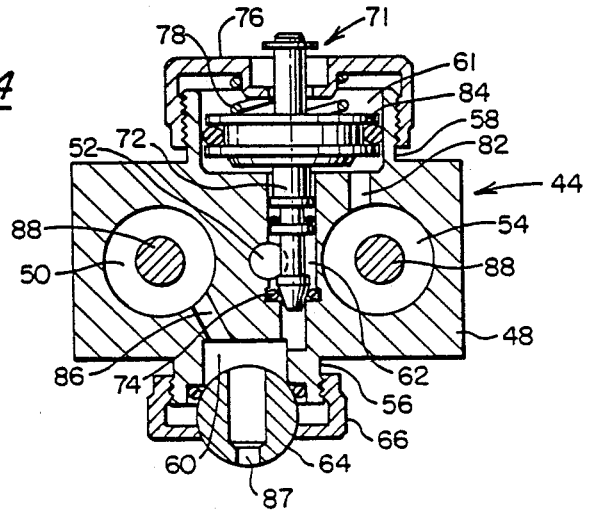
FIG. 4 is an elevationsl section view of a sprayhead module of this invention, taken along the line 4—4 of FIG. 1.

As seen in FIG. 1, a plurality of vertically and horizontally extending linear arrays, such as indicated generally at 40 and 42, are provided. Each linear array comprises a plurality of individual sprayhead modules 44, such as shown in FIGS. 3 and 4. The linear array or column 40 of modules 44 are interconnected to one another and to one of the appropriate manifold blocks at a first module in a manner wherein each is communicated to a common source of air pressure and liquid which is delivered outwardly through a spray nozzle as described in detail later herein. The pattern of liquid spray delivered to the mold or die surfaces is relatively easily determined by the chosen arrangement of the linear arrays 40 and 42 which may be varied in length and vertical or horizontal disposition in building block fashion in accordance with the present invention.

For example, as shown in FIG. 1, the outer most linear arrays or columns 40 are arranged as a closely spaced pair of vertical columns which are combined with a centrally located vertical column 40 which is joined to a pair of horizontally extending linear arrays 42 in a cross pattern.

Blank spacers such as 46, may be employed to more specifically orientate the modules 44 along the length of a given linear array or columns of modules. The modules 44 are also constructed to permit the face carrying the spray nozzle to be orientated in either of two 180 degree opposing directions to direct spray from a given linear array at opposing faces of the article forming machine with which it is employed.

Referring to FIGS. 3 and 4, module 44 includes a housing 48 provided with three parallel extending bores 50, 52 and 54 and a pair of threaded cylindrical lip portions 56 and 58 which form cavities 60 and 61.

Lip portion 56 is adapted to receive a conventional spherical nozzle member 64 held in position by a removable cap member 66. Lip portion 58 is adapted to receive a conventional pressure actuated valve means indicated generally at 71 having a valve stem 72 movably disposed in an interior passage 62 formed in housing 48 between open and closed positions relative to a valve seat 74. A retaining cap 76 is threadably received over lip portion 58 and houses a biasing spring 78 which biases valve stem 72 in the closed position against seat 74. The bores 30 have central/longitudinal axes which are at right angles to the central axis of the valve means 71.

Housing 48 also includes an interior passage 82 communicating bore 54 to an annular portion of cavity 61 formed below the enlarged stem portion 84 of the valve means. Another interior passage 86 communicates bore 50 with cavity 60 which in turn communicates with spherical nozzle member 64.

Bore 52 intersects passage 62 and therefore is selectively communicated to passage 60 and nozzle member 64 when valve stem 72 is moved upwardly away from valve set 74.

Therefore when air pressure is communicated to bores 50 and 54 and liquid is communicated to bore 52, valve stem 72 is forced upwardly away from valve seat 74 to permit liquid to flow through passage 62 into cavity 60. At the same time, air is also communicated to cavity 60 via bore 50 and interior passage 86 to effect a spray of liquid outwardly through passage 87 formed in nozzle member 64.

When the supply of air to bores 52 and 50 is terminated, valve stem 72 returns to its closed position against seat 74 to block communication of liquid to nozzle member 64 and air ceases to be similarly communicated through bore 50 and passage 84.

As best seen in FIGS. 3 and 4, adjoining modules 44 are connected by a tie rod 88 extending through a respective one of the bores 50 and 54 of linearly aligned modules 44. Tie rods 88 are of smaller diameter than bores 50 and 54 to form a sufficient annular space between the tie rods 88 and the walls of the bores permitting the effective passage of air through these supply ducts or passages as previously described.

As shown in FIG. 3, the last module in a linear array is provided with an end cap 90 to close the bores 50, 52 and 54 and is fitted in sealed engagement and aligned with the respective bores 50 and 54. An appropriate nut and washer assembly 92 functions to removably hold the linearly assembly together as well as provide a means to tighten the sealed relationship between abutting modules 44. An O-ring seal 94 is positioned in a recess surrounding the outlet of each bore 50, 52 and 54 to conventionally effect the sealed communication between the respective bores of the adjacent module 44.

In a similar fashion, conventional O-ring seals are disposed at the sealed junction of similar bores 50, 52 and 54 in spacer blocks 46 and at the junction of these bores and the outlet passages of the respective manifold blocks 30, 38 and 39 which are adjoined to the aligned bores 50, 52 and 54 of a given linear array.

Figure 5:
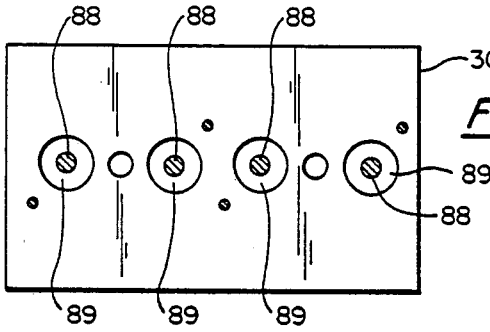
FIG. 5 is a bottom plan view of a typical manifold block accomodating a parallel pair of linear columns of sprayhead modules constructed in accordance with the present invention.
Figure 6:
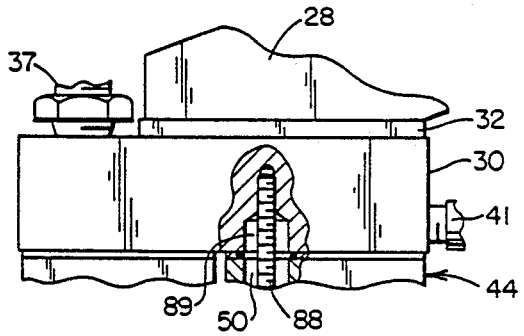
FIG. 6 is a partial front elevational view, partially in section of the manifold block shown in FIG. 5 illustrating the construction of an aligned outlet of the block and the terminal end of a tie rod employed to interconnect and communicate with a typical linear column shown in FIG. 1.

As best seen in FIGS. 5 and 6, the upper ends of tie rods 88 are threadably received in a recessed tapped hole provided within a passage 89 complementary to the bores 50 or 54 in each of the appropriate manifolds, such as 30, to join the linear array 40 to the appropriate manifold in the assembly.

Figure 7:
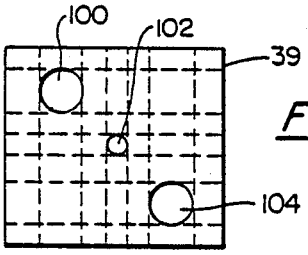
FIG. 7 is a rear elevational view of a typical junction manifold block construction for use with the present invention.
Figure 8:
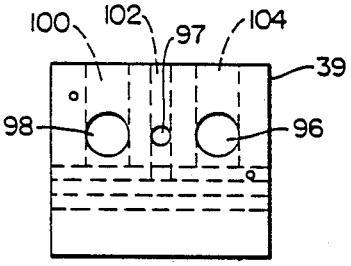
FIG. 8 is a side elevational view of the manifold block shown in FIG. 7.
Figure 9:
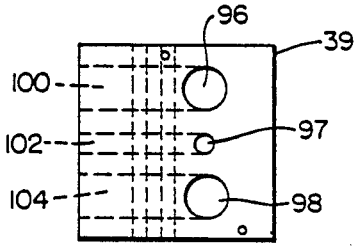
FIG. 9 is a top plan view of the manifold block shown in FIG. 7.

With reference to FIGS. 7 and 9, a manifold junction block 39 illustrative of the construction and purpose of blocks 38, 39 and 46 is shown. Each of these manifold blocks serve to extend, space or otherwise orient a given linear array in a horizontal or vertical direction while also performing the sample intercommunication function to properly communicate air and liquid as needed. Such blocks merely include vertically and/or horizontally drilled passages such as 96, 97 and 98 which conform to the bores 50, 52 and 54 of each module 44 which are linearly arranged and aligned to the passages 96, 97 and 98. In the case of block 39, wherein vertical and horizontal arrays 40 and 42 are formed, three cross-drilled passages 100, 102 and 104 are formed to intersect a respective one of the passages 96, 97 and 98 to intercommunicate each of these passages to the appropriate flow of supply air or liquid. Cross drilled passages 100, 102 and 104 are then conventionally plugged with threaded plugs, not shown, in a well-known manner to effectively serve to intercommunicate the respective vertical and horizontal passages 96, 97 and 98.

In manifold blocks, such as 39 or spacer blocks, such as 46, there is no need for a drilled and threaded passage 89 to receive the end of a tie rod 88, such as provided in blocks 22.

As seen in FIG. 3, preferably a pair of oppositely disposed positioning pins, such as 106 are provided on one end of housing 48 which is adapted to be received in a mated bore 108 provided in end cap 90 to aid in proper alignment of these adjoining components. Preferably, opposing ends of each nodule housing 48 are similarly provided with a similar pair of oppositely disposed positioning pins and mating bores to facilitate proper alignment between adjacent module components. Such alignment aids are also provided on spacer blocks 46 and manifolds 30, 38 and 39 as needed to properly align the bores 50, 52 and 54 of a module 44 with the proper outlet ports in these accessory components.

In most applications of the type described herein, it is desirable to provide an air spray to blow upon the mold surfaces. In the preferred embodiment shown herein, this is conveniently provided by an elongate blow tube, indicated generally at 110, which is operatively connected to the middle vertical array 40 via tie rods 88 extending through appropriate passages provided in blow tube 110. This construction also conveniently communicates air to the manifold passages conventionally provided within blow tube 110. In turn the air is communicated to a plurality of oppositely disposed nozzles 112 which may be directed toward the mold surfaces.

What is claimed is:

1. A modular spraying assembly for delivering a liquid spray through a plurality of nozzles that are capable of a variable orientation along vertical and horizontal axes of the assembly, comprising, in combination;

(1) a support means attached to and supporting the assembly;

(2) manifold block means mounted to said support means and including at least three separate manifold passages, with two of said passages in communication with a source of air at elevated pressure and the remaining passage in communication with a source of liquid to be sprayed;

(3) at least one linear extending array mounted on said manifold block means, including a plurality of interchangeable sprayhead housing module means, each array having a first and a last housing means, and each of said housing means including:

(a) a nozzle outlet port having a nozzle member mounted in communication with said outlet port;

(b) a pressure actuated valve means disposed within said housing in communication with a duct in said housing for selectively opening or closing off communication with said outlet port upon actuation of said valve means;

(c) at least three parallel bores extending through each said housing module means at generally right angles to the central/longitudinal axis of said nozzle outlet port and aligned with the respective parallel bores in adjacent housing means, forming distinct air and liquid supply passages common to each housing means in said linear array;

(d) a plurality of passage means operatively communicating with said air and liquid supply passages to said valve means and said nozzle means to effect the spray of liquid from said nozzle outlet port upon actuation of said valve means;

(4) the first of said housing module means in said linear array being aligned and connected to communicate said air and liquid supply passages to a respective one of the passages for liquid and air in said manifold block means, and to the remaining housing module means in said linear array, by a tie rod means extending through a respective one of at least the two of three parallel bores of each of said housing means and detachably connected to said manifold block means, said two bores having a diameter sufficient to accomodate said tie rod and an operable flow of air therethrough.

2. The spraying assembly defined in claim 1 including a plurality of separate linear extending arrays of sprayhead housing means, each of said separate linear arrays being connected to a manifold block means mounted to said support means and communicating with a source of liquid and air pressure.

3. The spraying assembly defined in claim 2 wherein said plurality of separate linear arrays include both vertically and horizontally disposed linear arrays oriented relative to one another to direct liquid from said nozzle outlet ports in a predetermined pattern.

4. The spraying assembly defined in claim 1 including a plurality of vertically disposed linearly extending arrays of said housing means mounted in horizontally spaced relationship from one another to said support means, at least one of said vertically disposed linear arrays communicating with a common manifold block having at least one linear array horizontally disposed at approximately a right angle to the vertical arrays.

5. The spraying assembly defined in claim 1 wherein said linear extending array of said sprayhead housing means includes at least one spacing block between certain of the adjacent housing means disposed along the axis of the linear extending array, said spacing block including at least three complementary parallel bores aligned with said parallel bores in each of said spray housings.

6. The spray assembly defined in claim 1 wherein said nozzle outlet ports of one or more of said housings in the same linear array are disposed facing in a 180 degree opposed direction relative to certain of the nozzle means of other housing means in the same linear array.

7. A modular spraying assembly for delivering a plurality of liquid sprays upon generally parallel opposed surfaces in a predetermined variable pattern formed along vertical or horizontal axes comprising, in combination; a plurality of substantially identical sprayhead module housings each including a nozzle means to dispense one of said liquid sprays and valve means for actuating the flow of liquid to said nozzle means, said housings being disposed in at least one linear extending array and each housing in a linear array commonly communicated to one another and to a common source of liquid and air pressure through at least three parallel aligned bores provided in each of said housings; common connecting means extending through each of said housings in each of said linear arrays and cooperating with a predetermined number of housings disposed in each of said linear arrays to vary the area of the spray pattern in a direction along the length of each of said linear arrays.

8. In a spraying assembly for applying a liquid coating onto the opposed mold surfaces of an article forming machine, the combination of; a plurality of substantially identical sprayhead modules, each including nozzle means to dispense said liquid coating and air actuated valve control means and each aligned in a linear extending array to dispose the nozzle means along a linear path having a variable length dependent upon the number of said modules in said linear array; a plurality of bores extending parallel to said linear array, formed in each of said modules and aligned to form common air and liquid supply passages to each of the modules in said linear array, said bores operatively communicated to each of said nozzle means and valve means in a respective one of said modules to selectively deliver a liquid spray through said nozzle means; and a connecting means extending through at least one of said aligned common supply passages of said modules to commonly connect each of said modules to one another in said linear array.

* * * * *